US005607315A

United States Patent [19]

Bonnah, II et al.

[11] Patent Number: 5,607,315

[45] Date of Patent: Mar. 4, 1997

[54] CONNECTOR FOR INJECTOR RETENTION AND ELECTRICAL CONNECTION TO A FUEL RAIL

[75] Inventors: Harrie W. Bonnah, II, Rochester, N.Y.; John Smith, Rancho Santa Fe, Calif.

[73] Assignee: Siemens Automotive Corporation, Auburn Hills, Mich.

[21] Appl. No.: 398,196

[22] Filed: Mar. 2, 1995

[51] Int. Cl.[6] ..... H01R 13/44

[52] U.S. Cl. ..... 439/130; 439/655; 439/192

[58] Field of Search ..... 439/638–655, 439/130, 924, 34, 190, 191, 199, 192

[56] References Cited

U.S. PATENT DOCUMENTS

| | | | |
|---|---|---|---|
| 4,844,036 | 7/1989 | Bassler et al. | 439/130 |
| 4,950,171 | 8/1990 | Muzslay | 439/130 |
| 5,129,834 | 7/1992 | Cranford | 439/130 |
| 5,131,857 | 7/1992 | Gmelin et al. | 439/130 |
| 5,238,415 | 8/1993 | Bittner et al. | 439/130 |

*Primary Examiner*—David L. Pirlot
*Attorney, Agent, or Firm*—Russel C. Wells

[57] ABSTRACT

A coupling element or attachment device mechanically and electrically mates a fuel injector to a plastic fuel rail. The attachment device electrically couples the male electrical connector to integral wiring within the fuel rail. The attachment device is preferably slidably engaged upon ribs or grooves on the fuel rail and slidably engaged to the male electrical connector. The device secures the fuel injector to the fuel rail without the necessity of a metal clip. The device may be manufactured from a unitary plastic molding. A plurality of attachment devices may be utilized to secure two or more fuel injectors to the fuel rail.

15 Claims, 2 Drawing Sheets

CONNECTOR FOR INJECTOR RETENTION AND ELECTRICAL CONNECTION TO A FUEL RAIL

FIELD OF THE INVENTION

The present invention relates generally to a fuel system for an engine, and more particularly to a retention clip for physically securing a fuel injector to a fuel rail and a connector for electrically coupling the fuel injector to the fuel rail.

BACKGROUND OF THE INVENTION

Fuel systems often include one or more fuel injectors physically coupled to a fuel rail. The fuel injector receives fuel from the fuel rail at a fuel input and provides the fuel at a fuel output for use by the engine in response to an electrical signal. The fuel injector typically includes a male electrical connector for receiving the electrical signal. The electrical signal is produced by an electronic injection control system or other electrical control system and is provided via at least one conductor to the male electrical connector.

Heretofore, fuel injectors have been physically (e.g., mechanically) coupled to the fuel rail by a metal clip. The metal clip mechanically secures the fuel input of the injector to an injector cup of the fuel rail and ensures that the fuel injector is maintained in the injector cup when the fuel is pressurized. Typically, fuel injectors have been electrically coupled to the electronic engine control system via a separate wiring harness. The wiring harness includes a female electrical connector sized to receive the male electrical connector on the fuel injector. Utilizing a separate metal clip to mechanically attach the fuel injector to the fuel rail and a separate wiring harness to electrically connect the fuel injector to the electronic injection control system is disadvantageous because separate clips and harnesses are expensive and require separate assembly steps when installing the fuel injector. Thus, there is a need for a single unitary attachment device which mechanically mates the fuel injector to the fuel rail and electrically couples the fuel injector to the electronic injection control system.

SUMMARY OF THE INVENTION

The present invention relates to a coupling element for electrically and mechanically coupling a fuel rail to a fuel injector. The fuel injector includes an injector interface having a first electrical contact, and a fuel rail including a fuel rail interface having a second electrical contact. The second electrical contact is coupled to integral wiring which is coupled to an electronic engine control system. The coupling element includes a coupling interface, an injector connector, and a second conductor. The coupling interface has a first conductor disposed to contact the second electrical contact when the coupling interface mechanically engages the fuel rail interface. The injector connector is disposed to contact the first electrical contact when the injector connector mechanically engages the injector interface. The second conductor is coupled to the first conductor and the injector connector. The coupling element mechanically and electrically couples the fuel rail to the fuel injector when the coupling interface mechanically engages the mechanical interface and the injector connector mechanically engages the injector interface.

The present invention also relates to an attachment device for electrically and mechanically mating a fuel rail to a fuel injector. The fuel injector includes a first injector connector, and the fuel rail includes a groove component having a plurality of rail electrical contacts. The attachment device includes a rail interface, a second injector, and a second conductor. The rail interface includes a channeled component having a plurality of first electrical contacts. The channeled component is configured to receive the grooved component. The first electrical contacts are coupled to the rail electrical contacts when the channeled component receives the grooved component. The second injector connector is configured to be coupled to the first injector connector when the channelled connector receives the grooved connector. The second conductor is coupled to the first electrical contacts and the second injector connector. The attachment device electrically couples the fuel rail to the fuel injector when the first injector connector mechanically engages the second injector connector and the channeled component receives the grooved component.

The present invention further relates to a method of electrically and mechanically coupling a fuel rail to a fuel injector in a fuel system. The fuel system includes the fuel injector having an injector interface with a first electrical contact, the fuel rail having a fuel rail interface with a second electrical contact, and a coupling element including a first coupling interface having a third electrical contact, a second coupling interface having a fourth electrical contact, and a conductor coupled to the third electrical contact and the fourth electrical contact. The method includes the steps of mechanically coupling the first coupling interface to the fuel rail interface and simultaneously electrically coupling the third contact to the second contact, thereby mechanically and electrically coupling the fuel rail to the coupling element, and mechanically coupling the injector interface to the second coupling interface and simultaneously electrically coupling the first electrical contact to the fourth electrical contact, thereby mechanically and electrically coupling the fuel injector to the coupling element.

The present invention even further relates to a unitary coupling element for electrically and mechanically connecting a fuel rail to a fuel injector. The fuel injector includes an injector interface having a first electrical contact and the fuel rail includes a fuel rail interface having a second electrical contact. The coupling element includes a fuel rail coupling means, an injector coupling means, and a conductor. The fuel rail coupling means has a third electrical contact and mechanically couples the fuel rail to the coupling element and electrically couples the third electrical contact to the second electrical contact. The injector coupling means has a fourth electrical contact and mechanically couples the fuel injector to the coupling element and electrically couples the first electrical contact to the fourth electrical contact. The conductor is coupled to the third electrical contact and the fourth electrical contact. The coupling element mechanically and electrically couples the fuel rail to the fuel injector when the fuel rail coupling means engages the fuel rail interface and the injector coupling means engages the injector interface.

In one implementation of the present invention, the attachment device may be a plastic, unitary molding with an internal conductor. The attachment device preferably couples a male electrical connector of a fuel injector to integral wires on a plastic fuel rail. The integral wires are coupled to an engine control system or other electronic control device. The attachment device advantageously mechanically and electrically joins the fuel injector to the plastic fuel rail as the attachment device slidably engages the male connector of the fuel injector. Preferably, the device slides at a 45° angle with respect to the direction of fuel flow in the fuel injector.

In another implementation of the present invention, the fuel injector may be mechanically coupled to the fuel rail without the use of external metal clips. The attachment device or coupling element includes channels configured to slide onto mating grooves located on the plastic fuel rail.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED

Exemplary Embodiment

Figure 1:
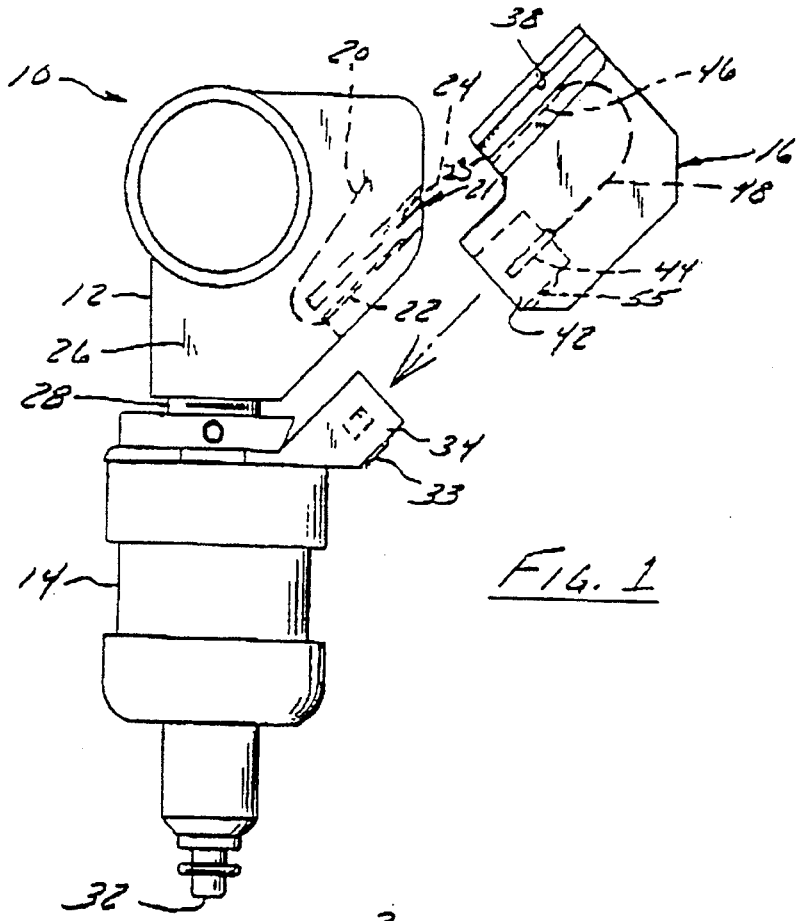
FIG. 1 is a side view schematic drawing of a fuel system including an attachment device in accordance with a first exemplary embodiment of the present invention.

Referring generally to the schematic drawing of FIG. 1, a fuel system 10 includes a fuel rail 12, a fuel injector 14, and a coupling element or attachment device 16. Fuel rail 12 can be fabricated from plastic and includes integral wiring 20 coupled to contacts 22. Integral wiring 20 is coupled to an electronic engine control system (not shown). Contacts 22 are disposed on ribs or mating grooves 24 associated with a fuel rail interface 21. Fuel rail 12 also includes an injector cup 26.

Fuel injector 14 includes an injector interface or a male electrical connector 34. Connector 34 preferably includes a tab 33. Injector 14 also includes a fuel input 28 which receives fuel from injector cup 26 of fuel rail 12. Injector 14 provides the fuel from fuel input 28 to a nozzle or fuel output 32 in response to one or more electrical signals received at male electrical connector 34. Injector 14 is slidably attached to rail 12 at fuel input 28, thereby permitting insertion, removal and replacement of injector 14 relative to rail 12.

Attachment device 16 includes an interface 23 having channels 38 mechanically configured to slide onto grooves 24 of interface 21. Attachment device 16 also includes an electrical injector interface or female electrical connector 42. Female electrical injector connector 42 includes a slot 55 for receiving tab 33 and female conductors 44 disposed to receive male conductors (not shown) within connector 34 when attachment device 16 is slidably engaged onto rail 12 and injector 14. Attachment device 16 also includes integral contacts 46 which are situated to be electrically coupled to contacts 22 when channels 38 are slidably engaged with grooves 24. Contacts 46 are electrically coupled to female conductors 44 via conductors 48.

Figure 2:
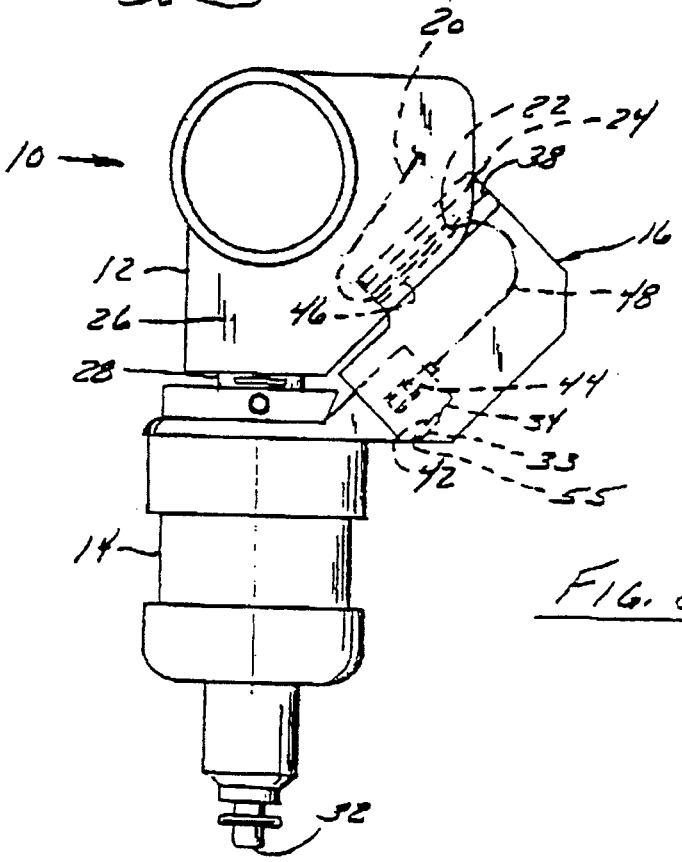
FIG. 2 is a side view schematic drawing of the fuel system illustrated in FIG. 1 showing the attachment device mechanically and electrically engaged with the fuel system.

With reference to FIG. 2, fuel system 10 is shown with attachment device 16 mated with fuel rail 12 and fuel injector 14. In accordance with this exemplary embodiment, attachment device 16 mechanically couples injector 14 to fuel rail 12 by physically connecting female electrical connector 42 to male connector 34 and joining interface 23 with interface 21 (see FIG. 3). Interfaces 21 and 23 are mechanically joined as grooves 24 of interface 21 are slidably engaged with channels 38 of attachment device 16. Attachment device 16 mechanically secures rail 12 to device 16 via the union of interfaces 21 and 23 and connectors 34 and 42.

Grooves 24, channels 38, male connector 34, and female connector 42 are disposed at an approximately 45° angle from the direction of fuel flow from fuel input 28 to fuel output 32. Attachment device 16 slidably engages fuel rail 12 and fuel injector 14 at a 45° angle with respect to fuel rail 12 or the central axis of fuel injector 14 (e.g., the direction of fuel flow) to more stably secure injector 14 to rail 12. Typically, when rail 12 is pressurized, pressurized fuel tends to force injector 14 away from injector cup 26. Attachment device 16 maintains the physical integrity of the connection between fuel rail 12 and fuel injector 14 despite the separation forces produced by pressurized fuel. The mechanical orientation of attachment device 16 with respect to rail 12 and injector 14 maintains or assists in maintaining the engagement of rail 12 and injector 14 when the fuel system is pressurized.

Attachment device 16 simultaneously electrically couples or connects fuel injector 14 to integral wiring 20 when device 16 mechanically couples injector 14 to rail 12. When male connector 34 engages (e.g., is coupled to) female connector 42, female conductors 44 are coupled to the male conductors (not shown) in male connector 34 and contacts 22 are connected to contacts 46. The male conductors (not shown) of fuel injector 14 are electrically coupled to wiring 20 via female conductors 44, conductors 48, contacts 46 and contacts 22. Therefore, injector 14 is electrically coupled to receive the one or more electrical signals from the electronic engine control system (not shown) via attachment device 16 and integral wiring 20. Attachment device 16 advantageously electrically and mechanically mates fuel rail 12 to fuel injector 14 simultaneously when connector 34 and interface 21 are slidably coupled to device 16.

Figure 3:
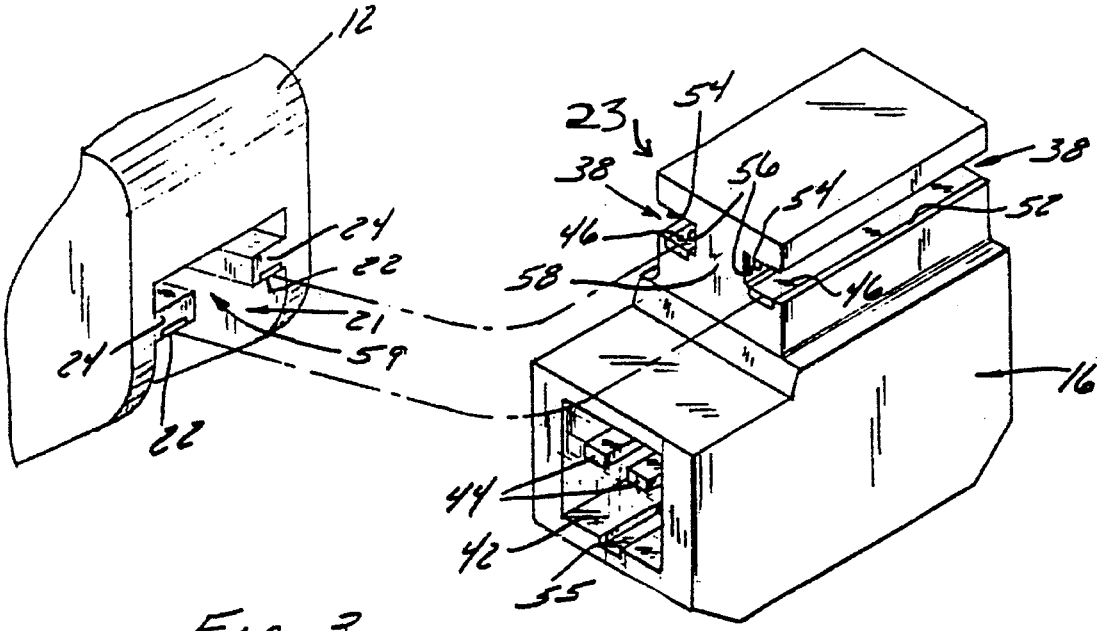
FIG. 3 is a more detailed perspective view schematic drawing of the attachment device illustrated in FIGS. 1 and 2.

With reference to FIG. 3, attachment device 16 is preferably a unitary plastic molded piece which includes contacts 46 integrally coupled with female conductors 44. Each contact of contacts 46 is separately coupled to one female conductor of conductors 44 via conductors 48 (FIG. 1 ). Female conductors 44 are located within female electrical connector 42, and contacts 46 are located on a bottom surface 52 of channels 38. Channels 38 are defined by bottom surface 52, top surface 54, and side surfaces 56. Channels 38 are configured to receive grooves 24 of rail 12. Side surfaces 56 define a central element 58 which slides into a slot or an aperture 59 in rail 12 when channels 38 receive grooves 24. Central element 58 and grooves 24 ensure a physically and electrically stable connection between rail 12 and attachment device 16.

Female electrical connector 42 is configured to encompass male electrical connector 34 and ensure a stable electrical and mechanical connection between injector 14 and device 16. Slot 55 preferably slides over tab 33 to provide a sturdy interconnection which resists twisting and rotation of connectors 34 and 42. Additionally, connectors 34 and 42 may include locking tabs (not shown) or key mechanisms (not shown) to latch or secure device 16 to injector 14.

Figure 4:
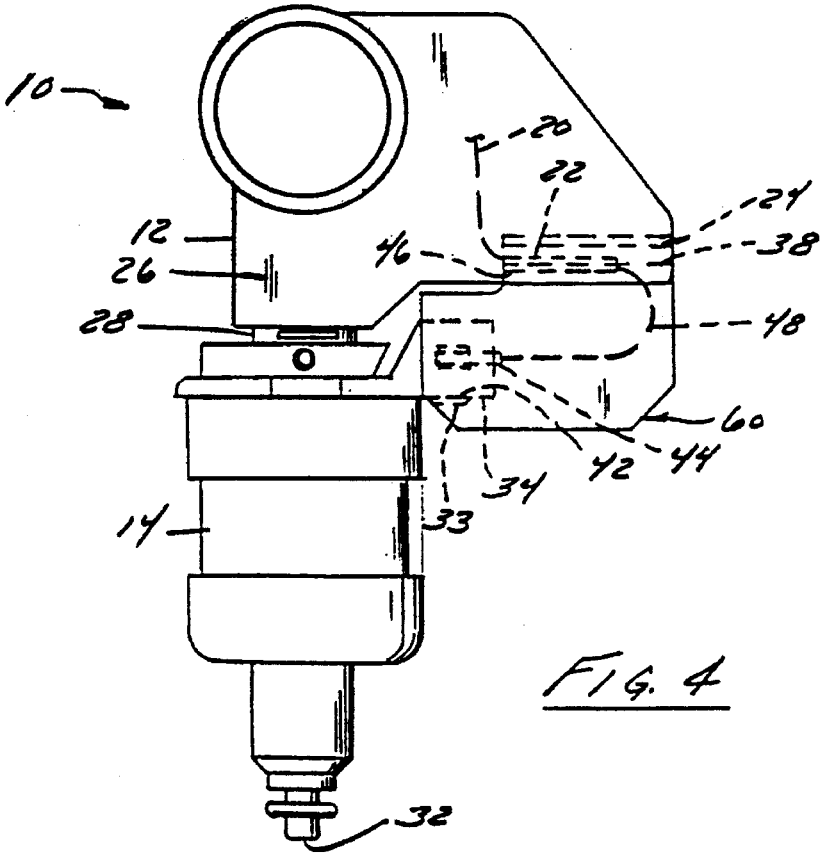
FIG. 4 is a side view schematic drawing of an attachment device engaged with a fuel system in accordance with a second exemplary embodiment of the present invention.

FIG. 4 shows an alternative embodiment of system 10 including a coupling element or attachment device 60 mechanically and electrically mating fuel rail 12 to fuel injector 14. System 10, illustrated in FIG. 4, is substantially similar to system 10 illustrated in FIGS. 1 and 2, except that male electrical connector 34 is disposed in parallel with fuel rail 12 or perpendicular to the flow of fuel from fuel input 28 to fuel output 32. Channels 38 and grooves 24 are also disposed in parallel with rail 12 or perpendicular to the flow of fuel from fuel input 28 to fuel output 32.

Other attachment devices 16 may be utilized in fuel system 10 depending upon the requirements of the particular application. For example, a fuel rail 12 for a four-cylinder engine may be electrically and mechanically coupled to four separate fuel injectors 14 with four separate attachment devices 16. Alternatively, a single attachment device may be configured to couple two or more fuel injectors 14 to the fuel rail 12. Further, each attachment device 16 can include its own integral conductors to complete the electrical circuit from fuel injector 14 to fuel rail 12. Additionally, the attachment devices may include fittings, grooves, keys, key seats, or channels to attach to neighboring attachment devices 16, thereby providing an interconnecting coupling scheme for devices 16.

It is to be understood that, while the detailed description and drawings show specific examples of the present invention, they are for the purposes of illustration only. The present invention is not limited to the precise details and conditions disclosed. For example, although a male electrical connector is shown on injector 14 and a female electrical connector is shown on attachment device 16, other types of interfaces between injector 14 and attachment device 16 may be utilized. Further, additional grooves, ribs, channels and apertures may be configured on attachment device 16 to secure rail 12 to fuel injector 14. Further still, although device 16 is preferably made of plastic, other materials may be suitable for use in fuel system 10. Various changes can be made to the details disclosed without departing from the spirit of the invention which is defined by the following claims.

We claim:

1. A coupling element for electrically and mechanically coupling a fuel rail to a fuel injector, the fuel injector including an injector interface having a first electrical contact and the fuel rail including a fuel rail interface having a second electrical contact, the coupling element comprising:

a coupling interface having a first conductor disposed to contact the second electrical contact of the fuel rail interface when said coupling interface mechanically engages the fuel rail interface;

an injector connector disposed to contact the first electrical contact of the fuel injector when said injector connector mechanically engages the injector interface; and a second conductor coupled to the first conductor and said injector connector, wherein the coupling element simultaneously mechanically and electrically couples the fuel rail to the fuel injector when said coupling interface mechanically engages the fuel rail interface and said injector connector mechanically engages the injector interface.

2. The coupling element of claim 1 wherein the fuel rail interface includes at least one mating groove and the coupling interface includes at least one channel, wherein the coupling interface slideably engages the fuel rail interface along the at least one channel.

3. An attachment device for electrically and mechanically mating a fuel rail to a fuel injector, the fuel injector including a first injector connector and the fuel rail including a grooved component having a plurality of rail electrical contacts, the attachment device comprising:

a rail interface having a channeled component having a plurality of first electrical contacts, the channeled component being configured to receive the grooved component, the first electrical contacts being coupled to the rail electrical contacts when the channeled component receives the grooved component;

a second injector connector being configured to be coupled to the first injector connector when the channel connector receives the grooved connector; and a second conductor coupled to the first electrical contacts and the second injector connector, whereby the attachment device electrically couples the fuel rail to the fuel injector when the first injector connector mechanically engages the second injector connector and the channeled component receives the grooved component.

4. The attachment device of claim 3 wherein the first injector connector is a male connector and the second injector connector is a female connector.

5. The attachment device of claim 3 wherein the attachment device is a unitary plastic molding.

6. The attachment device of claim 5 wherein the second conductor is located within the molding.

7. The attachment device of claim 3 wherein the grooved component includes two ribs and the channeled component includes two slots for slideably engaging the two ribs.

8. The attachment device of claim 7 wherein the two ribs and the two slots are disposed at approximately a 45 degree angle with respect to a vertical axis of the fuel injector.

9. The attachment device of claim 7 wherein the two ribs and the two slots are disposed at approximately a 90 degree angle with respect to a vertical axis of the fuel injector.

10. A method of electrically and mechanically coupling a fuel rail to a fuel injector in a fuel system, the fuel injector including an injector interface having a first electrical contact, the fuel rail including a fuel rail interface having a second electrical contact, and a coupling element including a first coupling interface having a third electrical contact, a second coupling interface having a fourth electrical contact, and a conductor coupled to the third electrical contact and the fourth electrical contact, the method comprising steps of:

mechanically coupling the first coupling interface to the fuel rail interface and simultaneously electrically coupling the third electrical contact to the second electrical contact, thereby mechanically and electrically coupling the fuel rail to the coupling element; and mechanically coupling the injector interface to the second coupling interface and simultaneously electrically coupling the first electrical contact to the fourth electrical contact, thereby mechanically and electrically coupling the fuel injector to the coupling element.

11. The method of claim 10 wherein the coupling element is a unitary element.

12. The method of claim 10 wherein the mechanically coupling steps are performed by sliding the coupling element onto the mechanical interface and injector interface.

13. The method of claim 12 wherein the mechanical interface and injector interface are dispose at a 45 degree angle with respect to a flow of fuel from the fuel rail to the fuel injector.

14. The method of claim 12 wherein the third contacts are integral with the first coupling interface.

15. A unitary coupling element for electrically and mechanically connecting a fuel rail to a fuel injector, the fuel injector including an injector interface having a first electrical contact and the fuel rail including a fuel rail interface having a second electrical contact, the coupling element comprising:

fuel rail coupling means, having a third electrical contact, for mechanically coupling the fuel rail to the coupling element and electrically coupling the third electrical contact to the second electrical contact;

injector coupling means, having a fourth electrical contact, for mechanically coupling the fuel injector to the coupling element and electrically coupling the first electrical contact to the fourth electrical contact; and means for electrically connecting the third electrical contact and the fourth electrical contact, wherein the coupling element mechanically and electrically couples the fuel rail to the fuel injector when the fuel rail coupling means engages the fuel rail interface and the injector coupling means engages the injector interface.

* * * * *